United States Patent [19]

Roser

[11] 4,073,231

[45] Feb. 14, 1978

[54] SELECTIVE LABEL PRINTER

[75] Inventor: Gerhard K. Roser, Mount Prospect, Ill.

[73] Assignee: Weber Marking Systems, Inc., Arlington Heights, Ill.

[21] Appl. No.: 745,549

[22] Filed: Nov. 29, 1976

[51] Int. Cl.[2] ..... B41J 3/22; B41F 15/02

[52] U.S. Cl. ..... 101/48; 101/90; 101/91; 101/116

[58] Field of Search ..... 101/90, 228, 91, 92, 101/116, 117, 118, 129, 52, 53, 48, 49; 74/568 R

[56] References Cited

U.S. PATENT DOCUMENTS

| | | | |
|---|---|---|---|
| 1,643,608 | 9/1927 | Priestley | 101/92 |
| 2,713,304 | 7/1955 | Thomas | 101/117 |
| 2,895,413 | 7/1959 | Ritzerfeld et al. | 101/91 X |
| 3,714,893 | 2/1973 | Cole | 101/228 |

*Primary Examiner*—Ronald E. Suter

*Attorney, Agent, or Firm*—Kenneth T. Snow

[57] ABSTRACT

A label printer of the type employing a stencil covered cylinder in which the stencil may have any one of plural arcuately spaced apart indicias cut therein separately printed therefrom. The label printer includes means for indexing the printing cylinder to any one of two or more positions for the optional printing of the separate contents of any one of the arcuately spaced apart portions of the stencil on the same machine.

5 Claims, 6 Drawing Figures

SELECTIVE LABEL PRINTER

BACKGROUND OF THE INVENTION

1. Field of the Invention

The label printer of this invention prints from a stencil. The stencils are preferably cut with the desired label indicia by a typewriter. Some labels contain the logo and shipping information of the sender as well as the name and address of the desired recipient. Such stencils would be substantially fully used over their lengths and require labels of a length similar to the length of the stencils. However, in many instances it is only desired to print the name and address of the addressee and in certain specialized uses it is only necessary and desirable to print an address of the recipient. This of course provides much more extra space on the standard size stencil as used with this same label printer. The printing of the stencil indicia is usually made on a pressure sensitive tape with a backing covering the adhesive until the label is desired to be applied to the envelope or package on which it is placed. The label printer is capable of printing labels of different lengths and this is controlled by the cooperation of a platen roller with the printing cylinder. Label stock is fed between the printing roller and its cooperative platen roller. When the rollers are in continuous engagement they act to pull label stock therebetween and the length of the labels will be the same whether the printing indicia on the stencil is short or long. The present label printer includes means to separate the cooperative rollers for selected periods of time to thus effect an intermittent feed out of label stock which can be made to correspond with the length of the indicia to be printed on the label. A cam is employed to move the platen roller away from the printing cylinder for that period of time when it is desired to stop the feeding of label stock between the rollers.

The present invention concerns the printing of short labels and further the utilizing of a single stencil to carry multiple label indicias thereon with mechanism on the label printer to optionally select which of the label indicias on the stencil shall be imprinted on the label stock.

2. Description of the Prior Art

The J. R. Thomas U.S. Pat. No. 2,713,304 discloses a label printer generally of the type employed in the subject invention. This early Thomas patent describes an adjustable cam to control label feed out length in a manner similar to the label feed out of the present invention. Weber Marking Systems, Inc., the assignee of the present application for patent, is also the owner of this Thomas patent. Weber Marking has manufactured and sold a label printer embodying the patented features of the Thomas patent for many years.

The Cole U.S. Pat. No. 3,714,893, also owned by Weber Marking Systems, Inc. represents an improved modification of the early Thomas label printer. Cole shows a label printing machine with an adjustable rotor cam for controlling separation of the printing cylinder and its cooperative rotary platen to provide for the accurate feeding of the desired amount of label stock.

The Roser U.S. Pat. No. 3,735,700 is also owned by Weber Marking Systems, Inc. and represents another improved feature on a stencil printing machine. In this patent the label stock used in the printer is accurately fed by a tire ring drive.

All of these earlier patents are directed to label printers and to the means for feeding label stock but no one of them shows a means for optionally indexing by rotating an entire cam rotor of fixed conformation to effect the separate printing of any one of plural indicias cut in a single stencil in combination with the controlled feed out of label stock commensurate with the length of the indicia being printed.

SUMMARY OF THE INVENTION

A principal object of this invention is to provide a novel label printer with means for selectively separately printing one of several spaced apart indicias cut on a single stencil.

An important object of this invention is to provide a novel label printer which may have its printing cylinder optionally arcuately indexed to any one of at least two positions for the optional printing of one of several indicias cut in a single stencil.

Another important object of this invention is to provide a novel label printer of the stencil type in which the stencil is preliminarily cut with several spaced apart indicias and whereby the label printer may optionally separately print any one of the several spaced apart indicias on successive labels, and which labels are commensurate in length to the length of the indicia being printed.

Still another important object of this invention is to provide a novel label printer as defined in the preceding object and further in which the printing cylinder of the printer is arcuately indexed to effect the printing of any desired one of the several spaced apart indicias.

Another and still further important object of this invention is to provide means for the economizing of stencils in stencil printing machines by cutting a single stencil with spaced apart indicias and optionally separately printing any one of the several indicias.

Other and further important objects and advantages will become apparent from the disclosures in the following specification and in the accompanying drawings.

IN THE DRAWINGS

AS SHOWN IN THE DRAWINGS

Figure 1:
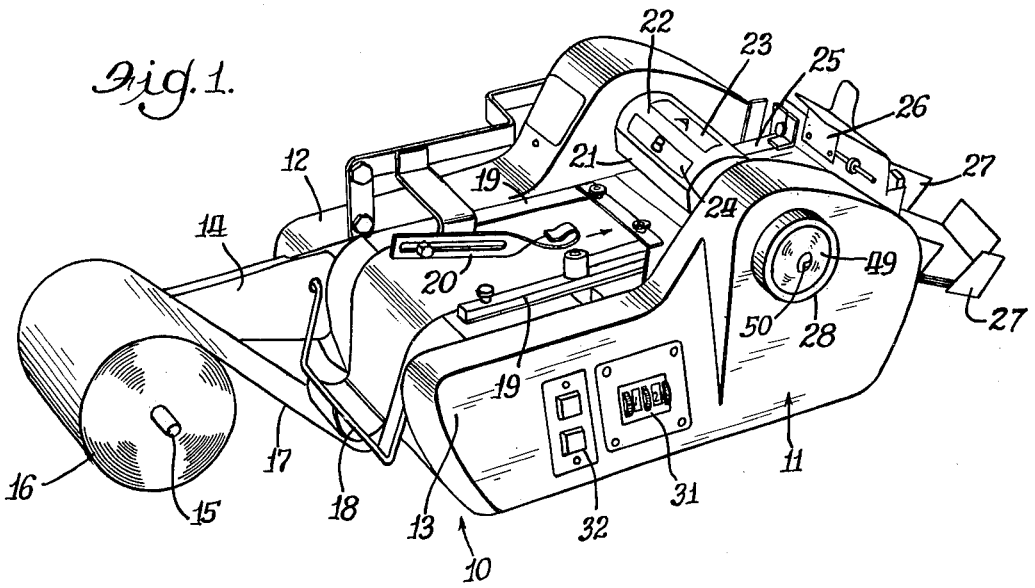
FIG. 1 is a perspective view of the label printer of this invention.

The reference numeral 10 indicates generally a label printer which employs a stencil to transfer desired indicia to a label. The printer is provided with a frame structure or housing 11 having spaced apart longitudinally extending side frame members 12 and 13. The frame member 13 itself includes an inner portion 13*a* and a spaced apart outer portion 13*b*. A cantilever arm 14 extends forwardly from the side 12 and supports a shaft 15 at its outer end in a generally transverse position relative to the longitudinal sides 12 and 13 of the frame support 11. A roll of label stock 16 is mounted on the shaft 15. The label stock is preferably of the type having a pressure sensitive adhesive on the under side with a removable backing sheet or carrier. A strip 17 of the label stock extends from the roll 16 rearwardly through the machine of this invention. An idler bar 18 is hingedly mounted on the side frame members 12 and 13 and is adapted to have its central portion hang by gravity onto the run 17 of label stock to provide for more control of that label stock as it moves through the printer of this invention. Spaced apart longitudinally extending side guides 19 are provided on the surface of the printer above and between the side members 12 and 13 for the purpose of guiding the label stock 17 through the machine printer. A pusher arm 20 is driven in an oscillating manner and is adapted to engage a pre-cut slit in the label paper whereupon it pushes the label to a predetermined point for proper print positioning. The pusher is not the primary means of moving label stock through the printer. Such primary movement is caused by the cooperation of the printing roller with the platen roller. It is the function of the pusher to insure the accurate positioning of the labels by imparting to the label a slight movement which results in the labels being properly indexed for centering of the printed indicia on each label.

Figure 5:
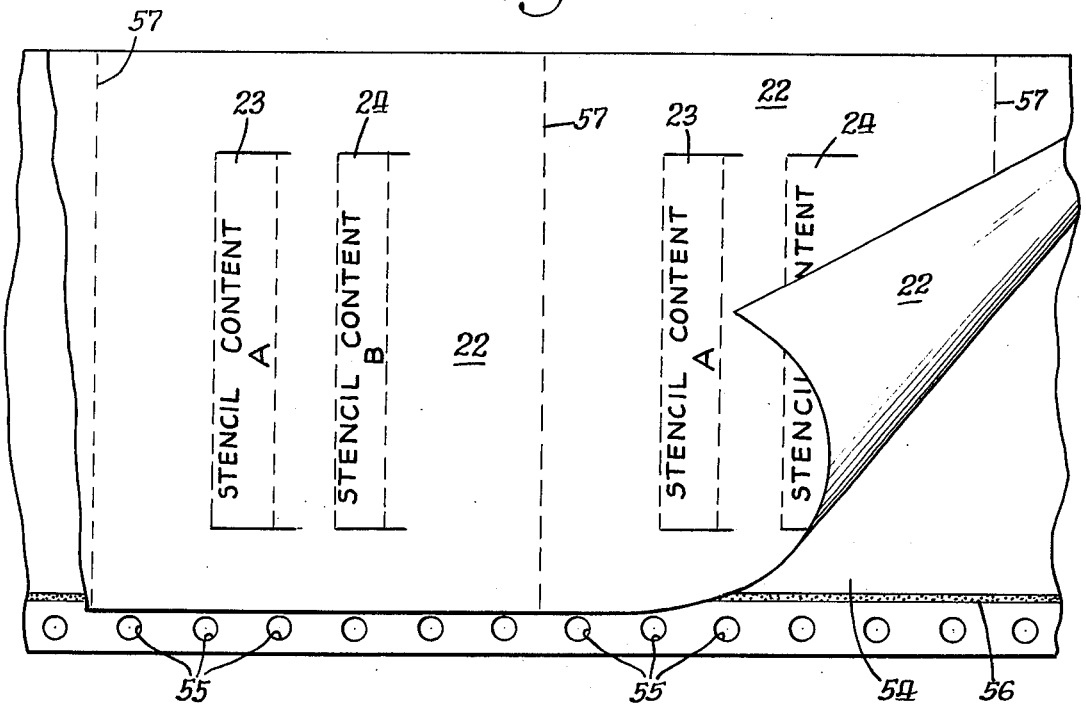
FIG. 5 is a plan view of the stencils used in the label printer of this invention.

A printing cylinder 21 is adapted to carry a pre-cut stencil 22 and when mounted in the correct position in the machine is capable of imparting an impression of the stencil indicia to the label stock. The stencil 22 is pre-cut with at least two separate indicias, such as addresses, which are desired to be separately printed onto labels. The numeral 23 designates stencil content A and the numeral 24 designates stencil content B. These stencil indicias are arcuately spaced apart on the stencil when the stencil is wrapped around the printing cylinder 21. FIG. 5 best shows the indicias 23 and 24 on the flat stencil 22 preliminary to its being used in the label printer of this invention.

The label printer further includes a knife stripper guide 25 and a knife 26 which is utilized to sever the label stock into individual labels or strips of labels for deposit into a finished label tray 27 on the rearwardly disposed end of the printing machine.

A handwheel or knob 28 is located on the outside of the side wall 13 and is the means used by an operator for manually controlling the arcuate setting of the printing cylinder 21. The handwheel is generally of a sleeve form and the mounting thereof will become apparent from the showing and description of FIGS. 3 and 4. A shaft 29 is journally carried in the frame structure 11 and has the printing cylinder 21 mounted thereon. A platen roller 30 is positioned beneath the printing cylinder 21. It is between these rollers 21 and 30 that the run of label stock 17 is fed and the stencil content imparted to that label stock when the platen is in rolling contact with the stencil covered printing cylinder. The label printer 10 is provided with a counter 31 for recording and controlling the number of label impressions made when the machine is in operation. A control panel 32 having an on and off switch is provided on the machine to effect starting and stopping of the device. A motor (not shown) is provided on the machine to cause it to operate.

Figure 2:
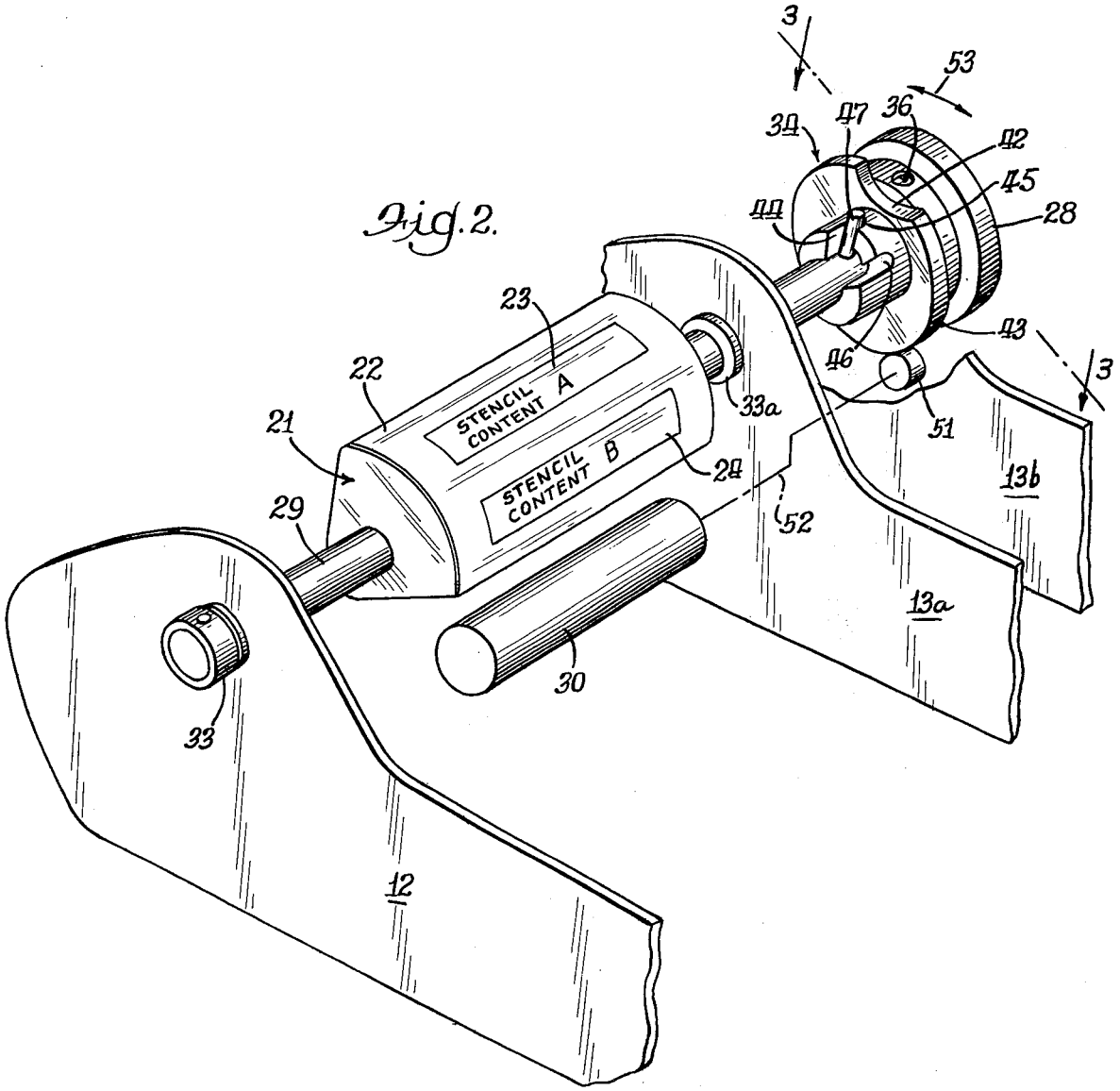
FIG. 2 is an enlarged perspective view detail of the printing cylinder and its effective indexing mechanism as used in the label printer of FIG. 1.
Figure 3:
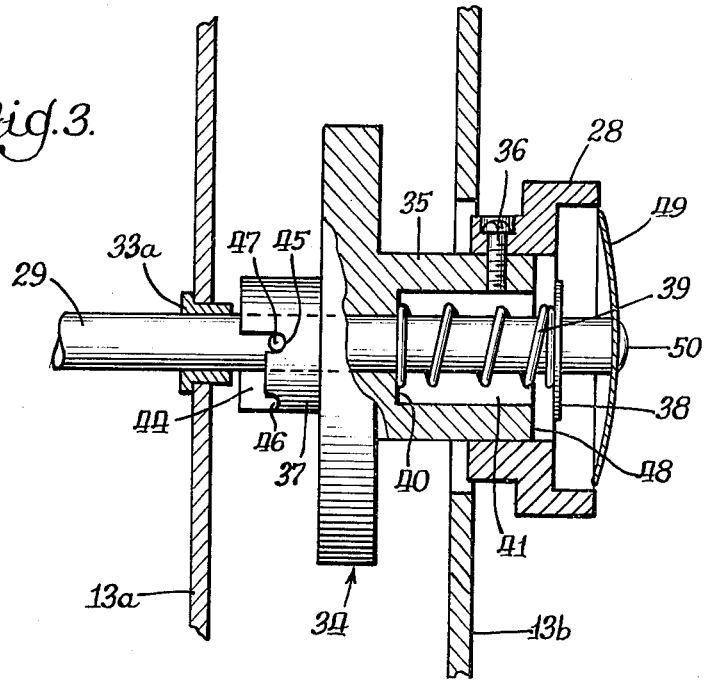
FIG. 3 is a sectional view taken on the line 3—3 of FIG. 2.
Figure 4:
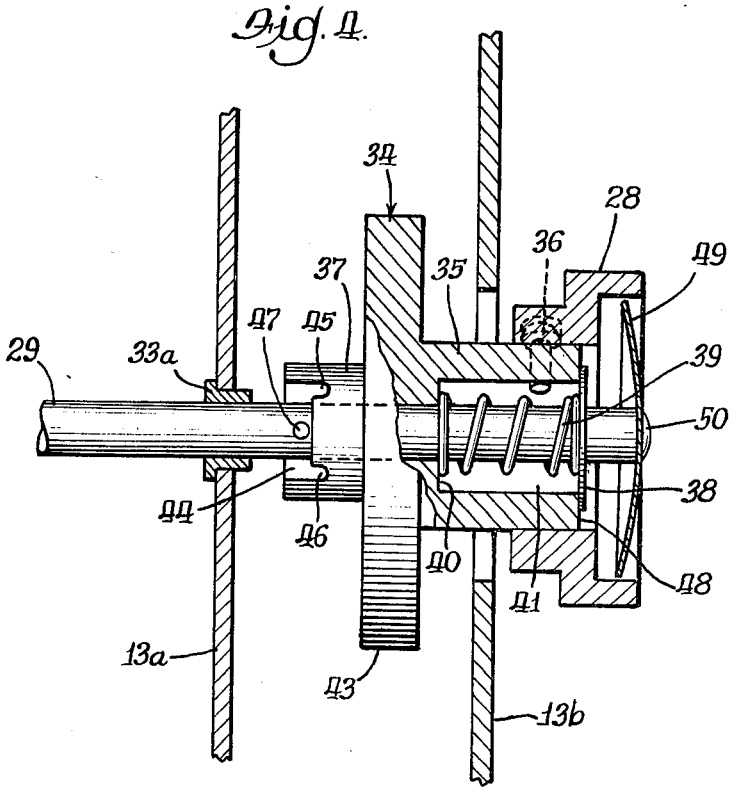
FIG. 4 is another sectional view similar to FIG. 3 in which the hand engaging knob has been manually pulled outwardly for effecting indexing of the printing cylinder.

FIGS. 2, 3 and 4 show enlarged details of the printing cylinder mounting in the label printer. The cylinder shaft 29 is journalled in the spaced apart side walls 12 and 13*a* in suitable bearings 33 and 33*a*. A cam rotor 34 has an integral axially extending, relatively large diameter first sleeve 35 which is directed toward and telescopes within the sleeve-like handwheel 28. As shown in FIGS. 3 and 4 a screw 36 passes radially through the rim of the handwheel 28 and into the sleeve 35 to thus hold the sleeve and the cam rotor as a unitary structure. Of course for servicing the parts may be easily unlocked by removal of the screw 36. The cam rotor 34 has a second oppositely disposed axially extending sleeve or hub 37, the inner surface of which has slidable movement on and along the shaft 29. The shaft 29 is provided with a fixed collar 38 located at a position generally within the confines of the hollow handwheel 28. A coil spring 39 is carried on and around the shaft 29 in such a manner that one end abuts an annular shoulder 40 formed on the inside of the cam rotor 34 and the other end of the spring abuts the fixed annular collar 38. The spring 39 is concealed and has its functional movement within a chamber 41 defined by the sleeve 35. The cam rotor 34 has a concave cut-out portion 42 in its outer circumferential surface which is designated by the numeral 43. A sector shaped notch 44 is provided in the inner exposed end of the cam rotor hub 37. This notch 44 is equipped with arcuately spaced apart radially disposed notches or slots 45 and 46 which are in fact deeper notches within the greater sector notch 44. A fixed post 47 is carried on the shaft 29 in a radial position and is adapted to lie within the confines of the notched sector 44 of the cam rotor hub 37. The post 47 may snuggly lodge within the radially disposed inner notch or slot 45 as shown in FIG. 3. To effect an indexing of the handwheel relative to the shaft 29 the handwheel is manually pulled axially outwardly against the normal action of the spring 39 until the outer circumferential end 48 of the sleeve 35 strikes the collar 38. The length of the first sleeve is such that the distance it moves until it abuts the fixed collar is an amount less than the overall depth of the sector notch and the deeper radial notches. In this position as shown in FIG. 4 the post is removed from the inner deeper notch 45 but is always retained within the sector notch 44. Now the knob 28 may be rotated an arcuate amount equal to but no greater than the angle of the sector notch 44 relative to the shaft 29 for ultimate engagement with the other inner or deeper notch 46. When the handwheel 28 has the shaft post 47 in engagement with either of its deeper radial notches 45 or 46 the handwheel and its now integral cam rotor 34 are fixed in their relative rotational position with the shaft 29. Thus the cam cut-out 42 may be locked in either of the two positions as determined by the post and notch interengagement. Obviously when the assembly is released of its manual pulling force as shown in FIG. 4 and the handwheel is located in either of its arcuate limit positions the spring immediately moves the handwheel and cam rotor assembly axially until it abuts the post 47 with one of its deep notches 45 or 46. Here the assembly remains in its fixed indexed position relative to the shaft and the printing cylinder until it is manually changed.

It is important that the handwheel be limited in its outward axial movement to insure the retention of the shaft post 47 within the sector notch 44. If the post were to be permitted fully out of the sector 44 it would be possible for the handwheel to be freely rotated 360° with the result the position of the cam notch 42 relative to the shaft could be completely disoriented. To obtain a completely finished appearance a convex shaped disc 49 is affixed by means of a center screw 50 to the end of the shaft 29. The disc 49 is smaller in diameter than the internal diameter of the sleeve-like handwheel. Thus when the handwheel is pulled outwardly relative to the shaft 29 the handwheel is actually pulled over the disc as shown in FIG. 4.

A cam roller 51 is associated with the platen roller 30 and has rolling contact with the surface 42–43 of the cam rotor 34. Reference numeral 52 designates a diagrammatic showing of a linkage disposed between the cam roller 51 and the platen roller 30. The linkage has been shown diagrammatically because it is identical to that shown in the prior patent to Cole U.S. Pat. No. 3,714,893 owned by our common assignee, Weber Marking Systems, Inc. The linkage 52 is preferably pivotally carried on the frame structure 11 and is swung through a limited range by the surface conformations of the cam rotor 34. When the roller 51 rides into the concave portion 42 of the cam rotor 34 the platen roller 30 swings up into engagement with the printing cylinder 21. Conversely when the roller rides out on the uncut surface 43 of the cam rotor the platen roller is swung away from its engagement with the printing cylinder.

When it is desired to imprint the labels with the stencil content B as shown at 23 the handwheel 28 and cam rotor 34 in assembled and locked condition are pulled outwardly against the action of the spring 39 and the assembly rotated as shown by the arrow 53 until the notch 45 of that assembly is aligned with the shaft post 47. Now the manual holding is relaxed permitting the assembly to move into locked position on the post 47. In this position the handwheel and cam rotor assembly and the printing cylinder and its shaft become as a single unit and rotate together. The cam rotor cut-out 42 is so located that when the post is in notch 45 the platen roller 30 will be in rolling engagement with the stencil content B and effect a transfer of the indicia of B to the label stock passing between the printing cylinder and the platen roller. Similarly when the post 47 engages the arcuately spaced apart notch 46 only the stencil content A will be imprinted on the label stock. Upon movement of the imprinted label stock through the machine the knife may be adjusted to actuate on each impression or after any desired number of impressions. In the set up as shown the knife is arranged to cut off six printed labels, and deliver them to the tray 27 whereby the tray conveniently holds many printed labels in a manner for convenient use.

FIG. 5 best shows the stencil construction for use with the label printer of this invention. A continuous carrier sheet 54 is punched with uniformly spaced holes 55 along the side edge thereof and provides the means of advancing and controlling the positioning of the stencil in machines used to cut the indicias in the stencil. A longitudinal strip of adhesive 56 is provided along the carrier sheet 54 at a position inwardly of the side holes 55 for the purpose of temporarily holding the stencils 22 to the carrier sheet. The stencil assembly of stencil, adhesive and backing or carrier sheet 54 is transversely perforated at 57 at regular intervals so the individual stencils may be inserted into a typewriter or other stencil cutting device and the indicias cut into the stencil as desired. The stencil assemblies are preferably marked with outline areas to define where the contents A are to be cut and similarly where the contents B are to be cut. After the stencil has its indicias cut within the outlined areas it is mounted on and around the printing cylinder. The positioning of the stencil on the printing cylinder is made the same every time so the cam rotor notches are correlated with the stencil contents and the cam rotor cut-out 42.

Figure 6:
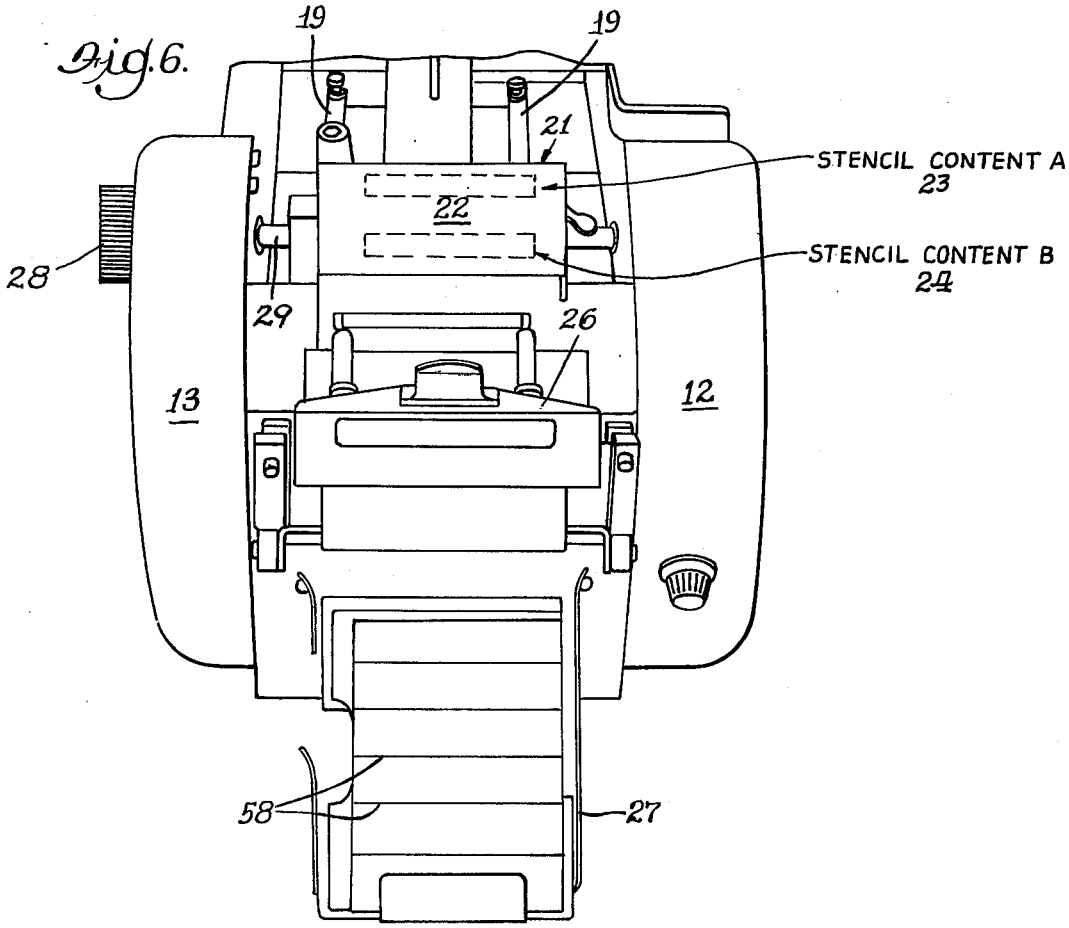
FIG. 6 is a rear elevational view of the label printer of FIG. 1.

FIG. 6 shows the successively printed labels 58 on the strip 17 of label stock. As explained, the imprinted labels may have either the indicia of A or the indicia of B imprinted thereon. And, it should be reemphasized that successive labels will all be only the separate content of either A or B when the shaft post 47 remains in a single deep notch 46 or 45 respectively of the cam rotor 34.

THE OPERATION OF THE DEVICE

A stencil 22 is precut with any desired indicia in two or more designated arcuately spaced apart areas such as shown at A or B. The cut stencil is then mounted on the printing cylinder as shown in FIGS. 1 and 2. If it is desired to print successive labels of only stencil content B then the handwheel and cam rotor assembly is manually adjusted to receive the shaft post 47 in the deep notch 45. Now, with the printing cylinder constantly rotating under motor power the cam rotor 34 with its cut-out 42 is also constantly rotated. As the cam roller engages the periphery 43 of the cam rotor 34 and moves radially inwardly of the cut-out 42 it causes the platen roller to engage only at A portion on the printing cylinder. This also simultaneously acts to feed an amount of label stock commensurate with the extent of the indicia in content A or content B. This, of course, is controlled by the length of concave cam notch 42. After the printed label stock passes the cutting knife 26 the cut and printed labels are deposited in the receiving tray 27. Now, if it is desired to print labels with stencil content A the handwheel and cam rotor assembly is indexed as previously described so that the shaft post 47 engages the deep radial notch 46.

Indexing is accomplished by an outward manual pulling on the handwheel 28 just a very short distance to effect disengagement of the shaft post 47 from the deep notch 45. At this point the knob 28 is rotated so the post 47 is now in alignment with the deep notch 46. The handwheel is now relaxed and the assembly is locked in its new arcuate position with the shaft 29. In this position the produced labels would be of A content to the exclusion of B content. Although only two indicias have been shown and only two indexing positions shown for the printing cylinder relative to the cam rotor it should be understood that any reasonable number of indicias can be cut and separately printed as desired with the device of this invention.

I am aware that numerous details of construction may be varied without departing from the principles disclosed herein and I therefore do not propose limiting the patent granted hereon otherwise than as necessitated by the appended claims.

What is claimed is:

1. A label printer comprising a frame structure, a shaft journally supported in said frame structure, a printing cylinder carried on and affixed for rotation with said shaft, a cam rotor journally mounted for relative rotation on said shaft spaced from said printing cylinder, said cam rotor having a continuously annular outer peripheral cam surface with one indentation therein, means for indexing said cam rotor arcuately relative to said shaft and printing cylinder to either of at least two fixed first and second arcuately spaced apart positions, a cam roller having rolling contact with the outer peripheral surface of said cam rotor, a platen roller cooperating with said printing cylinder to effect printing of label stock passed therebetween, means joining said cam roller and said platen roller in a manner to effect movement of said platen roller into and out of engagement with said printing cylinder as the roller rides against the outer peripheral surface of said cam rotor, said one indentation of the cam rotor determining the position and extent of contact of the platen roller with the printing cylinder, said indentation in the first indexed position of the cam rotor coordinated with a first position on said printing cylinder, said indentation in the second indexed position of the cam rotor coordinated with an arcuately spaced apart second position on said printing cylinder, a stencil for mounting on said printing cylinder having at least two spaced apart first and second indicias cut therein, said spacing of the first and second stencil indicias being equal in length to the arcuate spacing of the first and second indexed positions of the cam rotor, means mounting said stencil onto said printing cylinder so the first stencil indicia is on the first position of the printing cylinder and the second stencil indicia is on the second position of the printing cylinder, and whereby when the cam rotor is in the first of its indexed positions the cam rotor indentation is arranged to have the platen engage the printing cylinder for the printing of only the first of the spaced apart indicias on the stencil and when the cam rotor is in the second of its indexed positions the cam rotor indentation is arranged to have the platen engage the printing cylinder for the printing of only the second of the spaced apart indicias on the stencil.

2. A label printer as set forth in claim 1 in which said means for indexing said cam rotor includes said cam rotor having spaced apart radial notches in one side thereof and located at a position adjacent the surface of said shaft, a radial post affixed on said shaft on the side of said cam rotor having the notches and said post fitting in either of said cam rotor notches for locking said cam rotor in a fixed relationship with the shaft.

3. A label printer as set forth in claim 2 in which said means for indexing said cam rotor further includes means for sliding said cam rotor axially along said shaft, and spring means normally urging said cam rotor in an axial direction for engagement with said shaft post.

4. A label printer comprising a frame structure, a shaft journally supported in said frame structure, a printing cylinder carried on and affixed for rotation with said shaft, a cam rotor journally mounted on said shaft spaced from said printing cylinder, said cam rotor capable of having both axial and rotational movement relative to said shaft, said cam rotor having a continuously annular outer peripheral cam surface with one indentation therein, said cam rotor further having a hub portion separate from said continuously annular outer peripheral cam surface, said hub portion having first and second arcuately spaced apart radially disposed notches, a post affixed in a radial disposition in said shaft at a location between said printing cylinder and said assembly, spring means mounted on and around said shaft, a fixed collar on said shaft, said spring means disposed between said fixed collar and said cam rotor to urge said cam rotor axially of said shaft for effecting the interlocking engagement of the shaft post with one of the first and second radial notches in said cam rotor, a cam roller having rolling contact with the continuously annular outer peripheral cam surface of the cam rotor, a platen roller, said platen roller disposed adjacent the printing cylinder, means joining said cam roller and said platen roller in a manner to effect movement of said platen roller into and out of engagement with said printing cylinder as the roller rides against the outer peripheral surface of said cam rotor, said one indentation of the cam rotor determining the position and extent of contact of the platen roller with the printing cylinder, said indentation when the post is engaged with the first of said radial notches being coordinated with a first position on said printing cylinder, said indentation when the post is engaged with the second of said radial notches being coordinated with a second position on said printing cylinder, means moving a label stock between said printing cylinder and said platen roller, a stencil for mounting on said printing cylinder having at least two spaced apart first and second indicias cut therein, said spacing of the first and second stencil indicias being equal in length to the arcuate spacing of the cam rotor as determined by the post engagement with the first and second radial notches, means mounting said stencil onto said printing cylinder so the first stencil indicia is on the first position of the printing cylinder and the second stencil indicia is on the second position of the printing cylinder, and whereby when the cam rotor has the shaft post engaging the first of said radial notches only the first of said stencil indicias is printed on said label stock, and conversely when the post engages the second of the radial notches the second of said stencil indicias is printed on said label stock.

5. A label printer comprising a frame structure, a shaft journally supported in said frame structure, a printing cylinder carried on and affixed for rotation with said shaft, an assembly of elements journally mounted on said shaft spaced from one end of said printing cylinder, said assembly of elements capable of having both axial and rotational movement relative to said shaft, said assembly including a cam rotor having a continuously annular outer peripheral cam surface with one indentation therein, said cam rotor having a first sleeve extending axially in a direction away from said printing cylinder, said first sleeve having an internal diameter greater than the diameter of the shaft, and the sleeve and the shaft defining an annular chamber therebetween, said assembly of elements further including a sleeve-like handwheel having limited telescopic engagement with the first sleeve, a radially disposed screw passing through the sleeve and the handwheel at a position where these members telescope, said shaft having a fixed collar thereon at a location within the sleeve-like handwheel, a coil spring disposed around the shaft and within the defined annular chamber, said spring having one end thereof abutting said cam rotor and having its other end abutting said fixed collar, said spring acting to normally urge said assembly of elements toward said printing cylinder, said cam rotor having a second sleeve in the form of a hub extending axially in a direction opposite to the direction of the first sleeve and projecting toward the printing cylinder, said second sleeve hub having a sector notch cut in the inner end thereof, said second sleeve hub having arcuately spaced apart radially disposed deeper first and second notches located at the extreme sides of said sector notch, a post affixed in a radial disposition in said shaft at a location within said sector notch, said post adapted to engage either of said first or second deeper radial notches to thereby lock said assembly of elements in fixed arcuate relationship with said shaft, the outer end of said first sleeve abutting the fixed collar on the shaft when the assembly of elements is manually pulled outwardly against the action of the spring to thus limit the outward pulling of said assembly of elements, the length of the first sleeve being such that the degree of axial movement of the assembly of elements is less than the overall depth of the sector notch and the deeper first and second radial notches to thereby retain the shaft post within the confines of the sector notch during indexing of the assembly of elements from the engagement of the shaft post in the first deep notch to the second deep notch, a cam roller having rolling contact with the continuously annular outer peripheral cam surface of the cam rotor, a platen roller, said platen roller disposed adjacent the printing cylinder, means joining said cam roller and said platen roller in a manner to effect movement of said platen roller into and out of engagement with said printing cylinder as the roller rides against the outer peripheral surface of said cam rotor, said one indentation of the cam rotor determining the position and extent of contact of the platen roller with the printing cylinder, said indentation when the shaft post is in the first deep notch being coordinated with a first position on said printing cylinder, said indentation when the shaft post is in the second deep notch being coordinated with a second position on said printing cylinder, means moving label stock between said printing cylinder and said platen roller, a stencil for mounting on said printing cylinder having at least two spaced apart first and second indicias cut therein, said spacing of the first and second stencil indicias being equal in length to the arcuate spacing of the cam rotor as determined by the shaft post engagement with the first and second deep notches, means mounting said stencil onto said printing cylinder so the first stencil indicia is on the first position of the printing cylinder and the second stencil indicia is on the second position of the printing cylinder, and whereby when the assembly of elements has the shaft post engaging the first of said deep radial notches only the first of said stencil indicias is printed on said label stock, and conversely when the shaft post engages the second of the deep radial notches the second of said stencil indicias is printed on said label stock.

* * * * *